United States Patent [19]

Schiller, Sr. et al.

[11] Patent Number: 4,868,976

[45] Date of Patent: Sep. 26, 1989

[54] SPLICER TOOL

[76] Inventors: Valerian J. Schiller, Sr., Rte. 3, Box 3212, Belton, Tex. 76513; Reuben W. Schiller, P.O. Box 71, Rte. 1, Troy, Tex. 76579

[21] Appl. No.: 165,071

[22] Filed: Mar. 7, 1988

[51] Int. Cl.[4] ..... H01R 43/04

[52] U.S. Cl. ..... 29/749; 29/751; 29/758; 29/759; 72/409

[58] Field of Search ..... 29/749, 751, 752, 753, 29/759, 758; 72/409, 410

[56] References Cited

U.S. PATENT DOCUMENTS

| | | | |
|---|---|---|---|
| 550,879 | 12/1895 | Golling et al. . | |
| 2,326,709 | 8/1943 | Watson | 140/55 |
| 2,359,574 | 10/1944 | Maskrey . | |
| 2,485,874 | 10/1949 | Forst | 128/332 |
| 2,511,795 | 6/1950 | Cote . | |
| 2,555,903 | 6/1951 | Schroeder . | |
| 2,577,012 | 12/1951 | Hinckley et al. . | |
| 2,789,288 | 4/1957 | White . | |
| 3,023,416 | 3/1962 | Ytreland . | |
| 3,230,757 | 1/1966 | Filia | 72/410 |
| 3,289,456 | 12/1966 | Baldwin | 72/410 |
| 3,420,086 | 1/1969 | Long et al. | 72/338 |
| 3,427,852 | 2/1969 | O'Loughlin et al. | 72/410 |
| 3,611,782 | 10/1971 | Eppler | 72/410 |
| 3,707,867 | 1/1973 | Mayala | 72/410 |
| 3,710,610 | 1/1973 | McCaughey | 72/410 |
| 3,825,987 | 7/1974 | Smith et al. | 29/752 |
| 3,945,238 | 3/1976 | Eckert | 72/410 |
| 4,022,051 | 5/1977 | Ichikawa | 72/410 |
| 4,040,179 | 8/1977 | Sanchez | 29/751 X |
| 4,160,317 | 7/1979 | Sergeant | 29/751 X |
| 4,173,067 | 11/1979 | Steiner et al. | 29/751 X |
| 4,225,042 | 9/1980 | Anthone et al. | 206/332 |

*Primary Examiner*—Carl E. Hall

*Attorney, Agent, or Firm*—Richards, Harris, Medlock & Andrews

[57] ABSTRACT

A tool (10) facilitates use of self-stripping electrical connectors (12). The connectors are formed into a string held within a holder (14) and indexed sequentially to the forward end of the body where an integral pair of crimping pliers (16) activates the first connector in the string.

6 Claims, 1 Drawing Sheet

SPLICER TOOL

FIELD OF THE INVENTION

This invention relates to the use of self-stripping electrical pigtail connectors, and in particular to a tool for facilitating their use.

BACKGROUND OF THE INVENTION

In the past, making an electrical connection between two wires was a time-consuming and imperfect task. Often, the ends of the wires to be spliced had to be manually stripped of insulation, a task challenging in its own right because the conductive wire often was cut with the insulation. Once the ends of the wires were bared, they were then twisted together and soldered. After the soldered ends had cooled, they were then typically wrapped with insulating electrician's tape.

Recently, a self-stripping electrical pigtail connector has been developed which has made the connection of two wires much simpler. With such a connector, the ends of two wires to be spliced, with the insulation still in place, are inserted into apertures in the connector. A pair of pliers or the like is used to press an electrically conductive splicing element over the ends of the wires, cutting through the insulation to the conductor underneath, and thereby electrically connecting the wires. Often, an insulating plastic cap can be placed over the bridge splicer to insulate the connection. While these connectors have speeded splicing jobs, they are small and awkward to work with in tight quarters. Therefore, a need exists to enhance the advantage of such connectors by facilitating their use.

SUMMARY OF THE INVENTION

An apparatus is provided for use with a self-stripping electrical connector which includes a holder for holding a string of connectors and structure for indexing the first connector in the string to a predetermined position in the holder. In the predetermined position, a pair of wires can be inserted into the first connector. Structure is attached to the holder for operating the first connector while in the predetermined position to connect the pair of wires.

In accordance with other aspects of the present invention, the structure for indexing a first connector in the string in the predetermined position sequentially indexes each of the connectors in the string to the predetermined position for connection to a pair of wires. In accordance with another aspect, the structure for indexing the connectors can include a spring to urge the string of connectors toward the predetermined position. Further, structure can be provided for holding the first connector in the predetermined position for connection of the wires, with the holding force being overcome by pulling on the connected pair of wires and connector to remove the connector from the holder.

BRIEF DESCRIPTION OF THE DRAWINGS

A more complete understanding of the invention and its advantages will be apparent from the following Detailed Description, when taken in conjunction with the accompanying drawings, in which.

DETAILED DESCRIPTION

Figure 1:
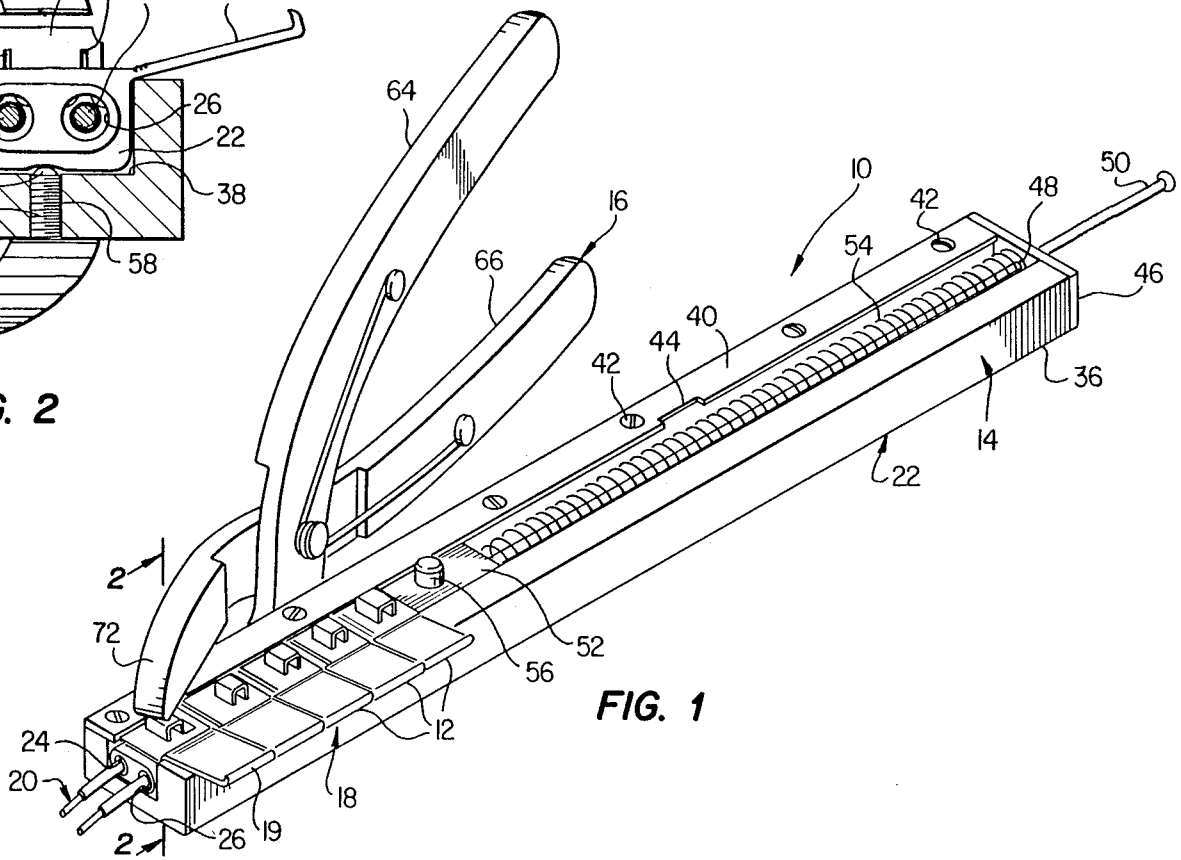
FIG. 1 is a perspective view of a first embodiment of the present invention.

With reference now to the accompanying drawings, wherein like reference characters designate like or corresponding parts throughout the several views, and in particular to FIG. 1, a tool 10 is illustrated for facilitating the use of self-stripping electrical pigtail connectors 12.

The tool 10 includes a holder 14 and crimping pliers 16 which are rigidly secured together. The holder 14 holds a string 18 of the connectors 12 and sequences the first connector 19 at the forward end of the string in a predetermined position for insertion of a pair of wires 20 and activation of the connector by the crimping pliers 16. Once crimped, the pair of wires 20 and attached connector are removed from the holder and the next connector in the string is automatically sequenced forward for attachment to the next pair of wires.

Figure 2:
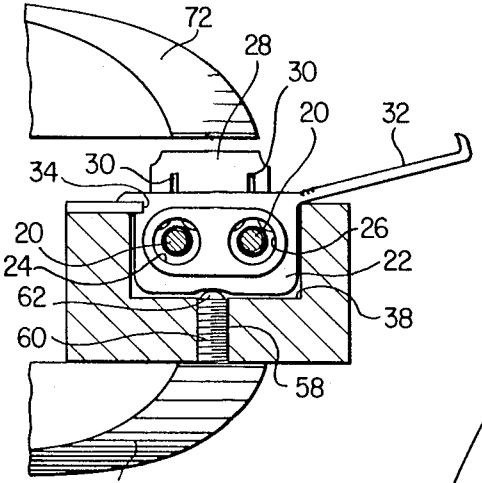
FIG. 2 is a cross section taken along line 2—2 in FIG. 1.

With reference to both FIGS. 1 and 2, the details of the connector 12 will be discussed further. The connector 12 includes a body 22 which has apertures 24 and 26 at one end of the body, with each aperture designed to receive one wire of the pair 20. A bridge splicer 28, formed of a conductive material, is mounted in the body for movement between an initial position, as seen in FIG. 2, to a splicing position. As the bridge splicer 28 moves to the splicing position, notches 30, seen in FIG. 2, cut through the insulation on the wires positioned in apertures 24 and 26 and create an electrical connection to the conductor within the wire. Because the action of the bridge splicer 28 in moving to the splicing position requires a fair amount of force, pliers are usually used to move the splicer into the splicing position. Once the splice is completed, a plastic cap 32 is bent over the splicer 28 and snapped into a groove 34 running along the side of the body 22 to isolate the splicer from the exterior of the body.

It can easily be seen that using connector 12 can be somewhat awkward. The wires must be inserted in the apertures 24 and 26, and held there as they are spliced. Somehow the operator must put the pair of pliers in the right position on the body, while holding the body and the wires in place. Usually, a number of connections are to be made at a single spot. The operator then has to fumble through a supply of these connectors, taking one out at a time to splice a pair of wires. The present invention overcomes these disadvantages. Extensive testing of the tool was performed and was able to cut time dramatically over the conventional method as will be set out hereinafter.

With reference again to FIG. 1, the body 22 can be seen to be an elongate member having a U-shaped frame 36 defining an elongate rectangularly shaped notch 38 along its length. A holding strip 40 is secured by screws 42 along one side of the upper surface of the frame 36. The strip 40 extends slightly into the notch 38 to engage the grooves 34 of the connectors in the string 18 to hold the connectors within the notch 38. A cutout 44 is formed in the strip 40 to allow the individual connectors to be placed in the string, as will be described hereinafter.

The rear end of the notch 38 is closed off by a plate 46. The plate 46 has an aperture 48 through which passes a spring rod 50. The rear end of spring rod 50 extends outside the rear end of the frame 36, while its forward end is attached to a guide block 52 slidable within the notch 38 and confined therein by the holding strip 40. A spring 54 surrounds the rod 50 and is confined at its ends by the plate 46 and the rear side of the guide block 52. A handle 56 is provided on the block 52 to facilitate grasping of the block.

To load a string of connectors within the body 22, the guide block 52 is moved against the force of spring 54 to near the plate 46, and at least behind the cut out 44. A number of connectors are then inserted into the notch 38 through the cutout 44. When the notch 38 is filled with the string of connectors, the block is released and the spring urges the block forward to bear against the rearmost connector in the string and push the string of connectors toward the front of the notch. As best seen in FIG. 2, a spring loaded detent 58 is provided at the front of notch 38 to hold the first connector in the string in position to receive the pair of wires to be connected. The detent 58 includes a spring 60 which urges a detent ball 62 partially into the notch 38 through the floor of the notch to engage the bottom of the connector, as seen in FIG. 2. Preferably, the detent 58 has sufficient force to prevent the spring 54 from pushing the connector out of the notch, but permits the connector to be pulled out of the notch after the pair of wires have been connected. As the connector is pulled out, the spring 54 pushes the next connector in line against the detent automatically, positioning it for splicing the next pair of wires.

The crimping pliers 16 are formed of hinged arms 64 and 66 hinged by rivet 68. Arm 64 defines a lower jaw 70 which is bolted, welded or otherwise fastened to the underside of the body 22 near the front edge of the body. Preferably, the attachment is at an oblique angle, as seen in FIG. 1, to allow suitable movement of the upper jaw 72 toward and away from the first connector in the string to crimp the pair of wires thereto.

In accordance with one embodiment of the present invention, the tool is designed for use with Model 557 self-stripping electrical pigtail connectors manufactured by the 3M Corporation of Minneapolis, Minnesota. In that embodiment the cutout 44 was onequarter inch long, the length of the body 22 was about ten inches. The height of the body on the side of notch 38 opposite that of strip 40 was 0.375 inches. The height of the body on the side with strip 40 was 0.344 inches. The strip 40 was about 0.031 inches thick and extended about 0.050 inches into the notch 38. The notch itself was about 0.450 inches wide and 0.250 inches deep. The body could hold about 10 connectors.

While one embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the scope and spirit of the invention.

We claim:

1. An apparatus for use with a self-stripping electrical connector having a groove along one edge, a pair of apertures on a first side for entry of a pair of wires and a bridge splicer for splicing the pair of wires, comprising:

a holder for holding a string of connectors, said holder including a body defining an elongate notch receiving said connectors and a strip extending into the notch to engage the groove on the side of the connectors in the string to hold the connectors within the notch, said holder having spring means for urging the connectors in the string toward a forward end of the body; and a pair of crimping pliers secured to the body near the forward end thereof and positioned oblique to the string of connectors for forcing the bridge splicer of the first connector at the forward end of the body to splice a pair of wires entered into the apertures of the first connector.

2. The apparatus of claim 1 wherein the strip has a cutout along its length to permit connectors to be inserted into the string within the body.

3. The apparatus of claim 1 having a spring-loaded detent at the forward end of the body to hold the first connector in place while connecting the pair of wires.

4. An apparatus for use with a self-stripping electrical connector having a groove along one edge, a plurality of apertures on the first side for entry of a plurality of wires, and a bridge splicer for splicing the plurality of wires, comprising:

a holder for holding a string of connectors, said holder including a body defining an elongate notch receiving said connectors and a strip extending into the notch to engage the groove on the side of the connectors in the string to hold the connectors within the notch, said holder having spring means for urging the connectors in the string toward a forward end of the body; and means attached to said holder near the forward end thereof for forcing the bridge splicer of the first connector at the forward end of the body to splice said plurality of wires entered into the apertures of the first connector.

5. The apparatus of claim 4 wherein the strip has a cutout along its length to permit connectors to be inserted into the string within the body.

6. The apparatus of claim 4 having a spring loaded detent at the forward end of the body to hold the first connector in place while connecting the pair of wires.

* * * * *